US011158242B2

(12) United States Patent
Yue et al.

(10) Patent No.: US 11,158,242 B2
(45) Date of Patent: Oct. 26, 2021

(54) DISPLAY DEVICE, DRIVER CIRCUIT, AND METHOD FOR DRIVING THE SAME

(71) Applicant: BOE TECHNOLOGY GROUP CO., LTD., Beijing (CN)

(72) Inventors: Han Yue, Beijing (CN); Xiaochuan Chen, Beijing (CN); Minghua Xuan, Beijing (CN); Jing Yu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/764,804

(22) PCT Filed: Dec. 16, 2019

(86) PCT No.: PCT/CN2019/125585
§ 371 (c)(1),
(2) Date: May 15, 2020

(87) PCT Pub. No.: WO2020/192188
PCT Pub. Date: Oct. 1, 2020

(65) Prior Publication Data

US 2021/0233461 A1 Jul. 29, 2021

(30) Foreign Application Priority Data

Mar. 28, 2019 (CN) ..... 201910243901.6

(51) Int. Cl.
*G09G 3/32* (2016.01)
*G09G 3/20* (2006.01)

(52) U.S. Cl.
CPC ..... *G09G 3/32* (2013.01); *G09G 3/2077* (2013.01); *G09G 2300/0852* (2013.01); *G09G 2310/08* (2013.01); *G09G 2320/0242* (2013.01)

(58) Field of Classification Search
None
See application file for complete search history.

(56) References Cited

U.S. PATENT DOCUMENTS

2008/0136750 A1* 6/2008 Benzarti ..... G09G 3/3233 345/76
2009/0096725 A1* 4/2009 Kretz ..... G09G 3/3233 345/82

(Continued)

FOREIGN PATENT DOCUMENTS

CN 107481664 A 12/2017
CN 108538241 A 9/2018

OTHER PUBLICATIONS

CN First Office Action in Application No. 201910243901.6, dated Mar. 5, 2020.

*Primary Examiner* — Chad M Dicke
(74) *Attorney, Agent, or Firm* — Syncoda LLC; Feng Ma

(57) ABSTRACT

A driving circuit for driving a target element with a driving current, including: a current source circuit connect to the target element and a first data line, wherein the current source circuit is configured to receive a first data signal through the first data line, and to control the magnitude of the driving current provided to the target element based on the first data signal; a time control circuit connected to the current source circuit, a second data line, and a pulse signal terminal, wherein the time control circuit is configured to receive a second data signal through the second data line, and to receive a periodic pulse signal via the pulse signal terminal, and to control the duration of the driving current provided to the target element in every driving period based on the second data signal and the periodic pulse signal.

20 Claims, 7 Drawing Sheets

(56) References Cited

U.S. PATENT DOCUMENTS

2015/0364087 A1* 12/2015 Gu ..... G09G 3/3233
345/78
2016/0189604 A1* 6/2016 Hu ..... G09G 3/3225
345/215

* cited by examiner

DISPLAY DEVICE, DRIVER CIRCUIT, AND METHOD FOR DRIVING THE SAME

CROSS-REFERENCE TO RELATED APPLICATION

The present application is a national stage of International Application No. PCT/CN2019/125585 filed on Dec. 16, 2019, which claims priority to Chinese Patent Application No. 201910243901.6 filed on Mar. 28, 2019. The disclosures of these applications are hereby incorporated by reference in their entirety.

FIELD

The present disclosure relates generally to the field of display technologies, and more specifically to a driving circuit, a driving method thereof, and a display device.

BACKGROUND

Electroluminescence (EL) refers to the phenomenon that when electrical current passes through a substance or a substance, light is emitted under a strong electric field. An electroluminescent device such as an Organic Light-Emitting Diode (OLED) can be fabricated by using this phenomenon. A type of light-emitting device such as a Quantum Dot Light-Emitting Diode (QLED) or a Micro Light-Emitting Diode (MicroLED) can be fabricated accordingly.

SUMMARY

Various embodiments of the present disclosure provide a driving circuit, a driving method thereof, and a display device.

In a first aspect, a driving circuit for driving a target element is provided, the driving circuit including:

a current source circuit connect to the target element and a first data line; wherein the current source circuit is configured to:

receive a first data signal through the first data line; and control the magnitude of the driving current provided to the target element based on the first data signal;

a time control circuit connected to the current source circuit, a second data line, and a pulse signal terminal, wherein the time control circuit is configured to:

receive a second data signal through the second data line;

receive a periodic pulse signal via the pulse signal terminal; and control the duration of the driving current provided to the target element in every driving period based on the second data signal and the periodic pulse signal.

In some embodiments, the time control circuit includes:

a first switching sub-circuit connected to the current source circuit and a first node, wherein the first switching sub-circuit is configured to control the on and off state of the driving current based on an electrical level at the first node;

a first holding sub-circuit, having:

a first terminal connected to the pulse signal terminal, and a second terminal connected to the first node, wherein the first holding sub-circuit is configured to maintain a voltage difference between the first terminal and the second terminal;

a first writing sub-circuit connected to the second data line, the first node and a first scan line, wherein the first writing sub-circuit is configured to control the on and off state of the connection between the second data line and the first node based on an electrical level of the first scan line.

In some embodiments:

the first switching sub-circuit includes a first transistor;

the first holding sub-circuit includes a first capacitor; and the first writing sub-circuit includes a second transistor; and wherein:

the first transistor has:

a gate connected to the first node, a first terminal connected to the current source circuit, and a second terminal connected to the target element through a light-emitting control circuit;

the first capacitor has:

a first terminal connected to the first terminal of the first holding sub-circuit, and a second terminal connected to the second terminal of the first holding sub-circuit; and the second transistor has:

a gate connected to the first scan line, a first terminal connected to the second data line, and a second terminal connected to the first node.

In some embodiments:

the driving circuit further includes the target element to be driven; and the current source circuit, the time control circuit, and the target element are connected in series between a first voltage terminal and a second voltage terminal of the driving circuit to provide a current path for the driving current.

In some embodiments, the current source circuit includes:

a driving transistor having a gate connected to a fourth node, a first terminal connected to the first voltage terminal, and a second terminal connected to the target element through the time control circuit;

a third capacitor have a first terminal connected to the fourth node, and a second terminal connected to the first voltage terminal; and a seventh transistor having a gate connected to the second scan line, a first terminal connected to the first data line, and a second terminal connected to the fourth node.

In some embodiments, the time control circuit includes:

a second switching sub-circuit connected to the current source circuit, a second node and a third node, wherein the second switching sub-circuit is configured to control the on and off state of the driving current based on electrical levels of the second node and the third node;

a second writing sub-circuit connected to the second data line, the first scan line and the second node, wherein the second writing sub-circuit is configured to control the on and off state of the connection between the second data line and the second node based on an electrical level of the first scan line; and a third switching sub-circuit connected to the second node, the third node and the pulse signal terminal, wherein the third switching sub-circuit is configured to control the on and off state of the connection between the periodic pulse signal terminal and the third node Q3 based on an electrical level of the second node.

In some embodiments:

the second switching sub-circuit includes a third transistor and a fourth transistor;

the second writing sub-circuit includes a fifth transistor;

the third switching sub-circuit includes a sixth transistor; and the time control circuit including a second capacitor: and wherein:

the third transistor has:

a gate connected to the third node a first terminal connected to the current source circuit; and a second terminal connected to a first terminal of the fourth transistor;

the fourth transistor has:

a gate connected to the second node;

the first terminal connected to the second terminal of the third transistor; and a second terminal connected to a terminal of the target element that receives the driving current;

the fifth transistor has:

a gate connected to the first scan line;

a first terminal connected to the second data line; and a second terminal connected to the second node;

the sixth transistor has:

a gate connected to the second node;

a first terminal connected to the third node; and a second terminal connected to the pulse signal terminal; and the second capacitor has:

a first terminal connected to the second node; and a second terminal connected to a common terminal of the driving circuit.

In some embodiments, the current source circuit includes:

a driving transistor having a gate connected to a fourth node, a first terminal connected to the first voltage terminal, and a second terminal connected to the target element through the time control circuit;

a third capacitor having a first terminal connected to the fourth node, and a second terminal connected to the first voltage terminal;

a seventh transistor having a gate connected to the second scan line, a first terminal connected to the first data line, and a second terminal connected to the target element through the time control circuit;

an eighth transistor having a gate connected to a third scan line, a first terminal connected to an initialization voltage line, and a second terminal connected to the fourth node; and a ninth transistor having a gate connected to the second scan line, a first terminal connected to the fourth node, and a second terminal connected to the target element through the time control circuit.

In some embodiments:

the target element is a light-emitting element; and the light-emitting element is configured to emit light according to the driving current.

In some embodiments:

the driving circuit further includes a light-emitting control circuit connected to the current source circuit and a periodic pulse signal line; and the light-emitting control circuit is configured to control the on and off sate of the driving current based on an electrical level of the periodic pulse signal line.

In some embodiments, the light-emitting control circuit includes a tenth transistor having:

a gate connected to the periodic pulse signal line;

a first terminal connected to the current source circuit; and a second terminal connected to the target element or the first voltage terminal.

In another aspect, a display device is provided, including:

a plurality of driving circuits each according to any one of claims 1-11; and a display screen including a plurality of micro light-emitting diodes (microLEDs) driven by the plurality of driving circuits.

In some embodiments, the plurality of driving circuits are configured to control gray scales of the plurality of microLEDs with both current and time.

In some embodiments:

the plurality of driving circuits are configured to control the gray scales with the time jointly through parameters of the second transistors, the first capacitors, and the first transistors.

In some embodiments:

the display device includes a display screen having a plurality of pixels formed with the plurality of microLEDs;

the plurality of driving circuits are configured to control the gray scales with the time by turning on the second transistors, thereby reading data to the first nodes; and a common signal changes with time and is shared by the entire display screen.

In some embodiments:

the plurality of driving circuits are configured to control the gray scales with the time by having voltage at the first node changing with the time; and a voltage difference between the first node and the common signal remains unchanged after the second transistors are disconnected.

In some embodiments:

the plurality of driving circuits are configured to the plurality of MicroLEDs by applying a turn-off voltage to the first transistors; and a turn-on time is controlled by a difference between a second data signal and the common signal, thereby controlling the gray scales according to characteristics of the plurality of MicroLEDs and improving efficiency and reducing color shift.

In another aspect, a method of driving a target element performed by the driving circuit described above is provided, the method including:

providing, in each driving cycle, the first data signal to the current source circuit through the first data line;

providing the second data signal to the time control circuit through the second data line;

providing the periodic pulse signal to the time control circuit via the periodic pulse signal terminal;

controlling, with the current source circuit, magnitude of the driving current; and controlling, with the time control circuit, duration of the driving current based on the second data signal.

In some embodiments, the time control circuit includes:

a first switching sub-circuit connected to the current source circuit and a first node Q1, wherein the first switching sub-circuit is configured to control the on and off state of the driving current based on an electrical level at the first node Q1;

a first holding sub-circuit, having:

a first terminal connected to the pulse signal terminal, and a second terminal connected to the first node Q1, wherein the first holding sub-circuit is configured to maintain a voltage difference between the first terminal and the second terminal;

a first writing sub-circuit connected to the second data line, the first node Q1 and a first scan line, wherein the first writing sub-circuit is configured to control the on and off state of the connection between the second data line and the first node Q1 based on an electrical level of the first scan line; and wherein the method further includes:

controlling the first writing sub-circuit via the first scan line so as to cause the second data line to connect with the first node during the preparation phase of each driving period by providing the first data signal to the current source circuit via the first data line, and providing the second data signal to the first writing sub-circuit via the second data line; and controlling the electrical level of the first node to vary according to the periodic pulse signal during the driving phase of each driving cycle by providing the periodic pulse signal to the first holding sub-circuit via the periodic pulse signal terminal so as to cause the first holding sub-circuit to maintain a voltage difference between the first voltage terminal and the second voltage terminal, wherein the driving phase of each driving cycle occurs after the preparation phase of each cycle.

In some embodiments, the time control circuit includes:

a second switching sub-circuit connected to the current source circuit, a second node Q2 and a third node Q3, wherein the second switching sub-circuit is configured to control the on and off state of the driving current based on electrical levels of the second node Q2 and the third node Q3;

a second writing sub-circuit connected to the second data line, the first scan line and the second node Q2, wherein the second writing sub-circuit is configured to control the on and off state of the connection between the second data line and the second node Q2 based on an electrical level of the first scan line;

a third switching sub-circuit connected to the second node Q2, the third node Q3 and the pulse signal terminal, wherein the third switching sub-circuit is configured to control the on and off state of the connection between the periodic pulse signal terminal and the third node Q3 based on an electrical level of the second node Q2;

wherein:

during the preparation phase of each driving cycle, the first data signal is provided to the current source circuit via the first data line;

the preparation phase occurs before the driving phase;

the driving phase includes at least two sub-phases, each sub-phased includes a writing phase and a subsequent display phase;

during the writing phase of each sub-phase, the second data signal is provided to the second writing sub-circuit via the second data line, the second writing sub-circuit is controlled by the first scan line so as to cause the second data line and the second node to be in an on or off state so as to make the second node to become the second data signal; and during the display phase of each sub-phase, providing the periodic pulse signal to the third switching sub-circuit via the periodic pulse terminal so as to cause the third switching sub-circuit to control the periodic pulse terminal to connect with the third node if the second data signal provide during the preparation phase is a valid electrical level, and based on the electrical levels at the second node and the third node, causing the second switching sub-circuit to turn on or off the current path.

Other embodiments may become apparent in view of the following descriptions and the attached drawings.

BRIEF DESCRIPTION OF THE DRAWINGS

In order to more clearly illustrate the technical solutions in the embodiments of the present disclosure, the drawings used in the description of the embodiments will be briefly described below. It will be understood that the drawings in the following description are only some embodiments of the present disclosure. Reasonable variations of these figures are also encompassed within the scope of the present disclosure.

DETAILED DESCRIPTION

Various embodiments of the present disclosure will be further described in detail below with reference to the accompanying drawings. It is apparent that the described embodiments are part of the embodiments of the present disclosure, and not all of the embodiments. All other embodiments obtained by a person of ordinary skill in the art based on the described embodiments of the present disclosure without departing from the scope of the invention are within the scope of the disclosure.

Unless otherwise defined, technical terms or scientific terms used in the present disclosure are intended to be understood in the ordinary meaning of the ordinary skill of the art. The words "first," "second," and similar terms used in the present disclosure do not denote any order, quantity, or importance, but are used to distinguish different components. "Comprising" or similar terms means that the elements or objects that appear before the word include the elements or items that appear after the word and their equivalents, and do not exclude other elements or items.

The words "connected," "operatively connected," or "coupled" and the like are not limited to physical or mechanical connections, but may include electrical connections, and the connections may be direct or indirect.

Depending on the type of device, the characteristics of some light-emitting devices tend to drift with changes in current density. That is, as the current density changes, these light-emitting devices not only undergo a significant change in the brightness of the light, but also a significant change in other characteristics. For example, the illuminating color coordinates of some Light-Emitting devices may shift significantly when the current density is too small or too large. For another example, the illuminating efficiency of some light-emitting devices may be too low in a certain current density range. When applied to a display, a light-emitting device having these characteristics is liable to cause various display defects such as color shift, over-shadow, low contrast, and the like.

Various embodiments of the present disclosure can alleviate display defects of a light-emitting device due to that characteristics of the light-emitting device can be easily drifted with a current density.

Figure 1:
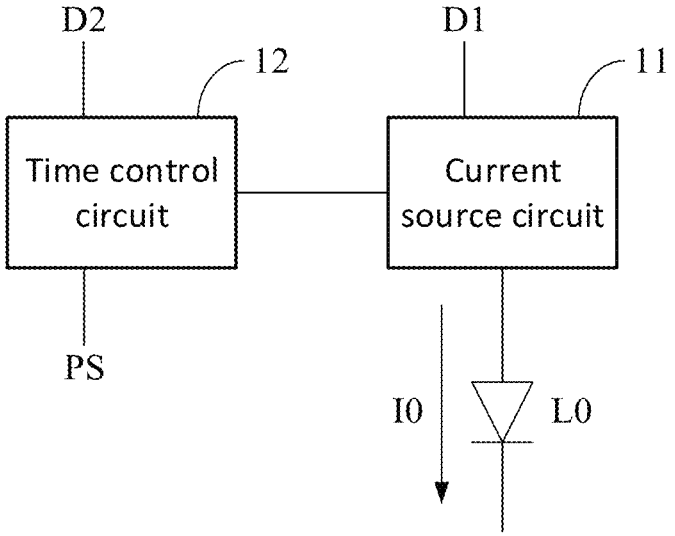
FIG. 1 is a structural block diagram of a driving circuit according to an embodiment of the present disclosure.

FIG. 1 shows a structural block diagram of a driving circuit according to an embodiment of the present disclosure. Referring to FIG. 1, the driving circuit includes a current source circuit or module 11 and a time control circuit or module 12. The current source circuit 11 is connected to a target element L0 (the to-be-driven element) and a first data line.

The current source circuit 11 is further configured to receive a first data signal D1 through the first data line and controls the magnitude of current provided to L0 based on the first data signal D1.

The time control circuit 12 is connected to the current source circuit 11, the second data line and the pulse signal terminal PS, respectively. The time control circuit 12 is further configured to receive a second data signal D2 through the second data line, a periodic pulse signal through pulse signal terminal PS, and then controls the duration for which the driving current I0 is provided to the element target L0 during each driving cycle based on the second data signal D2 and the periodic pulse signal.

The various device components, circuits, sub-circuits; units, blocks, or portions may have modular configurations, or are composed of discrete components, but nonetheless can be referred to as "circuits" or "modules" in general. In other words, the "components," "circuits," "sub-circuits," "modules," "blocks," "portions," or "units" referred to herein may or may not be in modular forms.

It should be noted that the target element L0 is represented by a symbol of a diode in FIG. 1, which may be, for example, a light-emitting element configured to emit light according to the driving current I0, for example, an organic light-emitting diode (Organic Light-Emitting Diode, OLED), Quantum Dot Light-Emitting Diode (QLED), and Micro Light-Emitting Diode (MicroLED or μLED).

It should also be noted that the periodic pulse signal is a discrete signal having a certain periodicity (i.e. the operating cycle of the driving circuit and the driving period corresponds to each other), and the parameters such as the waveform and duty ratio can be preset according to the requirements of a use case. In one possible implementation, the periodic pulse signal can be shared by all of the drive circuits in the array of drive circuits.

It should be noted that, in a possible manner of implementation, the current source circuit 11, the time control circuit 12, and the target element L0 are all on the current path of the driving current I0, and the current source circuit 11 can be based on the current path. The current regulation element controls the magnitude of the drive current I0, and the time control circuit 12 can control the duration of the driving current I0 during each drive cycle based on the switching elements on the current path.

In the exemplary statement above, the term "the current source circuit 11 is respectively connected to the element target L0 and the first data line" does not only include the case where the current source circuit 11 is directly connected to element L0, but may also include a current source.

The current path between the current source circuit 11 and element L0 may also include an indirect connection of other structures; and, to the extent possible, the various circuit structures on the current path can also exchange positions without affecting the desired function. In one example, the current source circuit 11, the time control circuit 12, and the target element L0 are connected in series between the first voltage terminal and the second voltage terminal of the driving circuit to provide the driving current.

For example, the driving circuit may have a first voltage terminal for connecting the anode voltage and a second voltage terminal for connecting the cathode voltage.

The first terminal of L0 and current source circuit 11 each is connected to either one of the first voltage terminal and the second voltage terminal. The second terminal of L0 is connected to the terminal of current source circuit 11 that provides a driving current Thus, the transmission path of the driving current I0 can be either "first power terminal-current source circuit 11-driven component L0-second power terminal", or "first power terminal-driven component L0-current source circuit 11-the second power supply terminal", and the implementation of the function of the drive circuit is not affected.

In some other embodiments, the time control circuit 12 may not be disposed on the current path of the driving current I0, and the duration of the driving current I0 in each driving cycle may be controlled by controlling the current source circuit 11. The adjustment can be implemented, for example, with reference to a current source circuit whose output duty ratio is adjustable, and will not be further described herein.

It can be seen that various embodiments of the present disclosure can respectively control the grayscale of the pixel in each driving cycle in two dimensions (i.e., current magnitude and current duration) via the current source circuit and the time control circuit, thereby ensuring that the current density of component L0 (e.g. a light-emitting device) remain in stable operating range.

This has the benefit of maintaining display contrast via the difference in current duration. Therefore, embodiments of the present disclosure can help alleviate display defects caused by the light-emitting device whose characteristics are easily drifted with current density and to improve the display performance of related display products.

Figure 2:
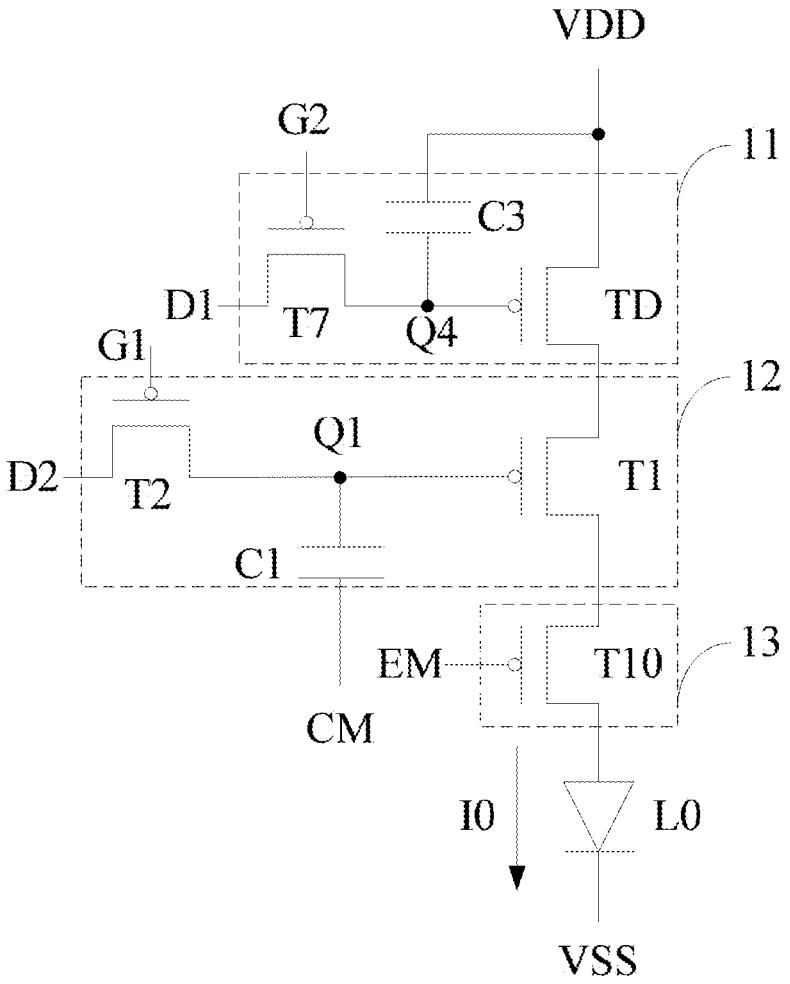
FIG. 2 is a circuit structural diagram of a driving circuit according to an embodiment of the present disclosure.
Figure 3:
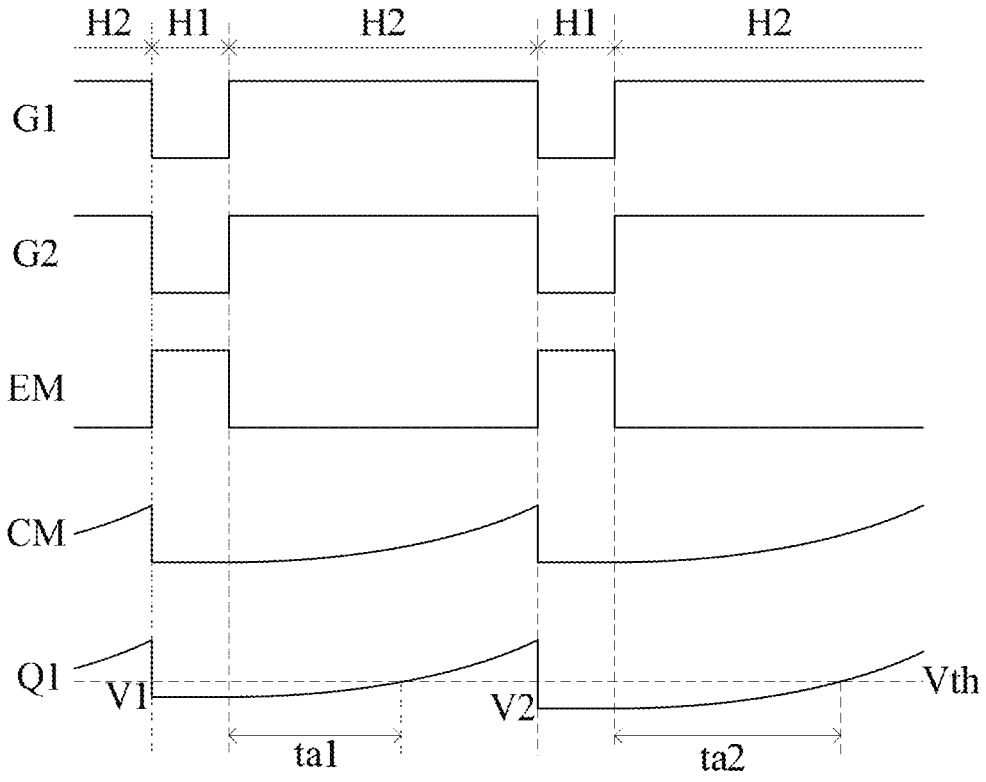
FIG. 3 is a circuit timing diagram of a driving circuit according to an embodiment of the present disclosure.

FIG. 2 shows a circuit structural diagram of a driving circuit provided by an embodiment of the present disclosure, and FIG. 3 shows a circuit timing diagram thereof.

Referring to FIG. 2 and FIG. 3, the driving circuit operates according to a periodic driving cycle (for example, a display frame), and each driving cycle includes a preparation phase H1 and a driving phase H2 after the preparation phase H1; the driving circuit includes a current source circuit 11, the time control circuit 12 and the light-emitting control circuit 13, wherein the current source circuit 11 includes a driving transistor TD, a transistor T7 and a capacitor C3; the time control circuit 12 includes a first switching sub-circuit (with transistor T1 as an implementation example), a first holding sub-circuit (with capacitor C1 as an implementation example) and a first writing sub-circuit (with transistor T2 as an implementation example), the light-emitting control circuit 13 includes a transistor T10. Further, the driving circuit in the embodiment of the present disclosure has a first voltage terminal VDD for connecting the anode voltage and a second voltage terminal VSS for connecting the cathode voltage.

In these embodiments, components of the driving circuit can be connected as follows: the gate of transistor T1 is connected to node Q1, and the first terminal of transistor T1 is connected to the current source circuit 11 for providing one end of the driving current I0, and the second terminal of T1 is connected to the target element L0 for receiving one end of the driving current I0.

The connection between the second terminal of T1 can the target element L0 can be through the light-emitting control circuit 13, for example, as illustrated in FIG. 2.

The first terminal of capacitor C1 is connected to node Q1, and the second terminal of capacitor C1 is connected to the periodic pulse signal CM. The gate of transistor T2 is connected to scan line G1, the first terminal of transistor T2 is connected to a second data line for providing the second data signal D2, and the second terminal of T2 is connected to node Q1.

The gate of the driving transistor TD is connected to node Q4, the first terminal of the driving transistor TD is connected to the first voltage terminal VDD, and the second terminal of TD is connected to the current source circuit 11 for providing the driving current I0.

The first terminal of capacitor C3 is connected to node Q4, and the second terminal of capacitor C3 is connected to the first voltage terminal VDD. The gate of transistor T7 is connected to the second scan line G2, the first terminal of transistor T7 is connected to a first data line of the first data signal D1, and the second terminal T7 is connected to node Q4.

The gate of transistor T10 is connected to the periodic pulse signal line EM, the first terminal of transistor T10 is connected to the time control circuit 12, and the second terminal is connected to the target element L0 for receiving the driving current I0. The lower terminal of element L0 is connected to the second voltage terminal VSS.

It should be noted that the terms "first terminal" and "second terminal" as used herein refer to the two terminals of a transistor which is not the gate, i.e. the source and the drain.

Depending on the specific type of transistor, the connection relationship between the source and the drain of the transistor can be separately set to match the direction of the current flowing through the transistor; when the transistor has a symmetrical structure of the source and the drain, the source and the drain can be regarded as two terminals that are not particularly distinguished.

It should also be noted that, for convenience of description, all of the transistors shown in the drawings are exemplified by a P-type transistor (which is turned on when the gate is at a low level and turned off when the gate is at a high level in a simplified model); however, it should be understood that, on the basis of this, all or some P-type transistors can be replaced by N-type transistors, and in this case, it can be implemented with simple adaptive design (for example, high and low level interchange of signals) consistent with embodiments of the present disclosure. Circuit functions of the same circuit structure are not described herein.

As can be seen in FIG. 3, the first scan line G1 is a level at which each of the second transistor T2 operates in one of a linear region or a saturation region in each of the preparation phases H1 (low level). The second scan line G2 is a level (low level) for operating the seventh transistor T7 in one of the linear region or the saturation region in each of the preparation phases H1. It should be understood that when both transistor T2 and transistor T7 are the same type of transistors, the first scan line G1 and the second scan line G2 can be combined into the same scan line, which helps save the line layout space.

In the time control circuit 12, the first switching sub-circuit is configured to control, according to the level of node Q1, a current path of the current source circuit 11 to supply a driving current I0 to the target element L0. Turning on and off, for example, the transmission path of the drive current I0 is turned off when the voltage of node Q1 is outside the turn-on voltage range.

Taking transistor T1 as an example, when the voltage at node Q1 causes transistor T1 to operate in a cut-off region outside the linear region and the saturation region, transistor T1 is in a closed state, thereby disconnecting the transmission path of driving current I0. The first holding sub-circuit is configured to maintain a voltage difference between the first end and the second end, and the first end and the second end are respectively connected to the pulse signal end PS and node Q4.

Taking capacitor C1 as an example, when it is not charged or discharged, it can maintain the voltage difference across the terminals by maintaining the amount of stored charge. The first writing sub-circuit is configured to control conduction and disconnection between the second data line and node Q1 according to a level on the first scan line G1.

For example, the second data signal D2 is written into node Q4 in the preparation phase H1. Taking transistor T2 as an example, the first scan line G1 in the preparation phase H1 is at a low level, so that transistor T2 is turned on, and the second data signal D2 is written to node Q1.

It can be seen in FIG. 3 that the level of the periodic pulse signal EM is the same waveform with high and low variations in each of the driving phases H2, such as a monotonously varying waveform (monotonous in FIG. 3).

It can be inferred that the level of node Q1 in each driving phase H2 will monotonously change with the periodic pulse signal EM under the action of the first holding sub-circuit, and the level changes. The starting point is determined by the second data signal D2 in the previous preparation phase H1; therefore, there may be a period in the driving phase H2 in which the voltage at node Q1 is outside the turn-on voltage range, and the duration of the period is indirectly determined by the second data signal D2.

Based on the above principle, the time control circuit 12 can control the current source circuit 11 to provide the target element L0 according to the written second data signal D2 in each driving cycle, the duration of the drive current I0.

In an example, referring to FIG. 3, in two adjacent driving cycles, the second data signal D2 in the previous driving cycle sets the voltage of node Q1 to V1, and in the latter driving cycle, the second data signal D2 sets the voltage of node Q1 to V2, such that V1 and V2 respectively serve as the starting point of the periodic pulse signal EM with the voltage of node Q1 in the two driving phases H2.

When the condition for transistor T1 to be in an ON state is that the gate voltage is less than its threshold voltage Vth, the voltage of node Q1 in each driving phase H2 is lower than the threshold voltage Vth of transistor T1, which is the length of time during which the transmission path of the drive current I0 is allowed by time control circuit 12.

It can be seen from FIG. 3 that in the previous cycle, the time duration allowed by time control circuit 12 for the transmission path of the driving current I0 is ta1, and in the next cycle the duration for the transmission path of the driving current I0 allowed by the time control circuit 12 is ta2. The difference between the two is determined by the difference in height between V1 and V2.

Based on this principle, the above-mentioned duration corresponding to each voltage value of the second data signal D2 can be determined by theoretical calculation and/or experimental method, thereby controlling the duration of driving current I0 supplied to L0 by current source circuit 11 during each cycle according to this correspondence relationship.

It should be understood that the waveform of the periodic pulse signal EM in the period other than the driving phase H2 may not be particularly limited, and the above monotonous variation may be in the form of a linear function, an exponential function, a power function, a parabola, etc., and may not be particularly limited.

In addition, when the periodic pulse signal EM is inverted into a form of monotonously decreasing in each driving phase H2, the duration of the voltage of node Q1 in each driving phase H2 is lower than the threshold voltage Vth of transistor T1 is still determined by the previously written second data signal D1.

It can be seen from this that the periodic pulse signal EM can be arbitrarily set within a possible range on the basis of the condition that the same waveform having a high and low variation in each of the driving phases H2 is satisfied. Exemplarily, the periodic pulse signal EM may also include several sub-periods in each driving phase H2, and may be a monotonously varying waveform in each sub-period, or a level in some of the sub-periods, or the level of each sub-period is constant and the level between different sub-cycles is different, and so on.

Referring to FIG. 3, in current source circuit 11, the transistor T2 is turned on in each preparation phase H1, so that the first data signal D1 is written to node Q4 and is under the charge storage of capacitor C3. It is maintained, in the subsequent driving phase H2, the first data signal D1 previously written at node Q4 will control the magnitude of the source leakage current of the driving transistor TD under the clamping of capacitor C3. Thereby, the current source circuit 11 can realize the function of supplying the driving current I0 to the target element L0 according to the written first data signal D1.

Referring again to FIG. 3, in light-emitting control circuit 13, the periodic pulse signal line EM is at a high level in each preparation phase H1 and a low level in each driving phase H2, whereby transistor T10 is turned off in each of the preparation phase H1, and turned on in each of the driving phases H2, thereby realizing the function of disconnecting the transmission path of the driving current I0 in each of the preparation phases H1.

It can be understood that the implementation of this function may not be limited to the above manner. In a modified example, the same function may be realized by configuring the gate of T10 to be connected to period pulse signal line EM, one terminal of T10 to be connected to the VDD end of the current source circuit 11, the other terminal of T10 to be connected to the first voltage terminal VDD. Similarly, the driving current I0 can be disconnected in each of the preparation stages H1. That is, the light-emitting control circuit 13 can be disposed at any position in the transmission path of the drive current L0.

Figure 4:
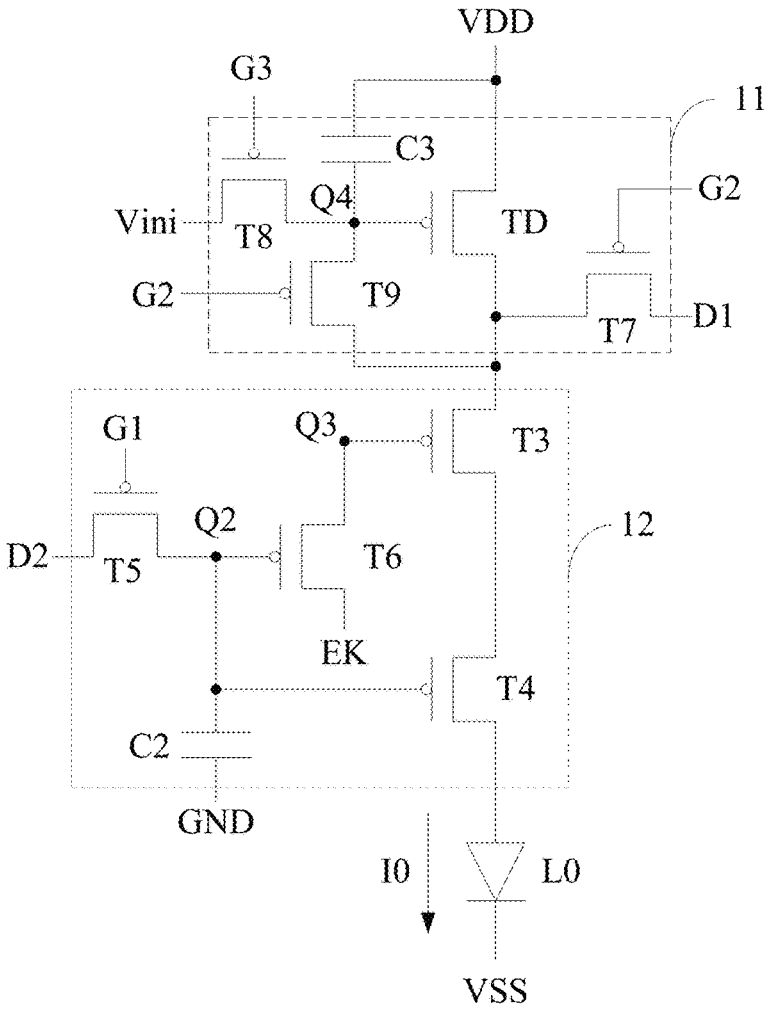
FIG. 4 is a circuit structural diagram of a driving circuit according to another embodiment of the present disclosure.
Figure 5:
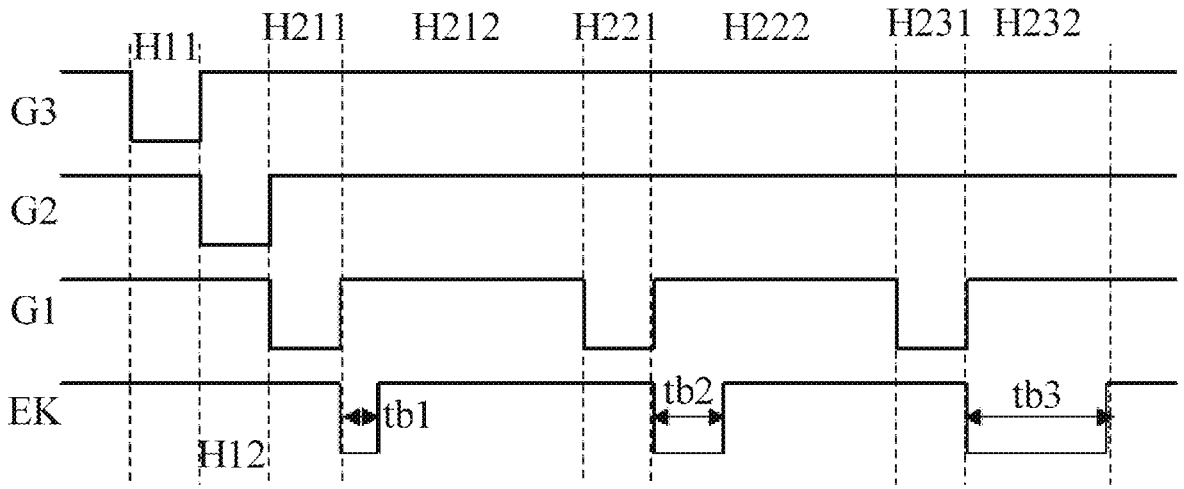
FIG. 5 is a circuit timing diagram of a driving circuit according to still another embodiment of the present disclosure.

FIG. 4 shows a circuit structural diagram of a driving circuit according to another embodiment of the present disclosure, and FIG. 5 shows a circuit timing diagram thereof.

Referring to FIG. 5, the driving circuit operates according to a periodic driving cycle (for example, a display frame), and each driving period includes a preparation H1 and a driving phase H2 after the preparation H1, and each preparation phase includes an initialization H11 and an initialization H11.

Subsequent compensation H12, each drive phase H2 comprises at least two sub-phases, each of which includes a write phase and a display phase after the write phase. Three sub-phases are shown as an example in FIG. 5: a first sub-phase (including a first write phase H211 and a first display phase H212), and a second sub-phase (including a second write phase H221 and a second display phase H222) and a third sub-phase (including a third write phase H231 and a third display phase H232).

Referring again to FIG. 5, the driving circuit includes current source circuit 11 and time control circuit 12, wherein the current source circuit 11 includes a driving transistor TD, transistors T7, T8, T9, and a capacitor C3. The time control circuit 12 includes a second switching sub-circuit (with a combination of transistors T3 and T4 as an implementation example), a second writing sub-circuit (with transistor T5 as an implementation example), and a third switching sub-circuit (with transistor T6 as an implementation example) and a capacitor C2.

In the connection relationship, the gate of transistor T3 is connected to node Q3. A first terminal of transistor T3 is connected to the current source circuit 11 for providing one end of the driving current I0, and a second terminal of T3 is connected to a first terminal of transistor T4. The gate of transistor T4 is connected to node Q2, the first terminal of transistor T4 is connected to the second terminal of transistor T3, and the second terminal of T4 is connected to the target element L0 for receiving one end of the drive current I0.

The gate of transistor T5 is connected to the first scan line G1, the first terminal of transistor T5 is connected to the data line for providing the second data signal D2, and the second terminal is connected to node Q2. The gate of transistor T6 is connected to the node Q2, the first terminal of transistor T6 is connected to node Q3, and the second terminal is connected to the pulse signal end PS that provides the periodic pulse signal EK.

The first terminal of capacitor C2 is connected to node Q2, and the second terminal of capacitor C2 is connected to the common terminal GND of the driving circuit. The gate of the driving transistor TD is connected to node Q4, the first terminal of the driving transistor TD is connected to the first voltage terminal VDD, and the second terminal is connected to the current source circuit 11 for providing the driving current I0. The first terminal of capacitor C3 is connected to node Q4, and the second terminal of capacitor C3 is connected to the first voltage terminal VDD.

The gate of transistor T7 is connected to the second scan line G2, the first terminal of transistor T7 is connected to the data line for providing the first data signal D1, and the second terminal is connected to the current source circuit 11 for providing the drive current I0. The gate of transistor T8 is connected to the third scan line G3, the first terminal of transistor T8 is connected to the initialization voltage line Vini, and the second terminal is connected to node Q4. a gate of transistor T9 is connected to the second scan line G2, a first terminal of transistor T9 is connected to node Q4, and a second terminal is connected to the current source circuit 11 for providing one end of the drive current I0.

As can be seen in FIG. 5, the first scan line G1 is made in each of the writing stages (for example, the first writing phase H211, the second writing phase H221, and the third writing phase H231). Transistor T5 operates at a level (low level) of one of a linear region or a saturation region, and the second scan line G2 makes transistor T7 in each of the compensation phases H12. Working at a level (low level) of one of a linear region or a saturation region, the third scan line G3 is operating the linear region and saturation of transistor T8 in each of the initialization phases H11, the level of one of the zones (low level).

In time control circuit 12, the second switching sub-circuit is configured to control the current source circuit 11 to the target element when the one of node Q2 and Q3 is at an inactive level L0 provides a current path for driving current I0 to be disconnected.

Taking the combination of transistors T3 and T4 as an example, when either node Q2 or Q3 are at a high level as an inactive level, transistor T3 and transistor T4 are not in the same state, whereby the transmission path of the drive current I0 is turned off.

The second writing sub-circuit is configured to control conduction and disconnection between the second data line and node Q2 according to a level on the first scan line G1, for example, in each of the second data signal D2 is written to node Q2 during the write phase.

Taking transistor T5 as an example, the first scan line G1 is at a low level in each write phase, so that transistor T5 is turned on during these periods, and the second data signal D2 is written to node Q2, it is held by the charge storage of capacitor C2 when capacitor C2 is present.

The third switching sub-circuit is configured to control conduction and disconnection between the pulse signal terminal PS and the third node Q3 according to a level of the second node Q2, for example, at the second node the periodic pulse signal EK is supplied to node Q3 when the effective level is Q2.

Taking transistor T6 as an example, when node Q2 is at a low level as an active level, transistor T6 is turned on, so that the periodic pulse signal EK is written to node Q3.

It can be seen in FIG. 3 that during the display phase of the different sub-phases, the duration of the periodic pulse signal EK is at an active level (e.g., the first display phase H212, the second display phase H222, and the three display phase H232, the durations tb 1, tb2, and tb3 of the periodic pulse signal EK at the active level are different.

Therefore, it can be inferred whether the periodic pulse signal EK is written into node Q3 in each sub-phase, and data signal D2 written to node Q2 in the writing phase of the sub-phase is active.

The level can also be determined by the inactive level. As an example, if data signal D2 in the writing phase H211 is at a low level as an active level, transistor T4 and transistor T6 are turned on, and thus, the period pulse signal EK in the display phase H212 controls transistor T3 to be turned on for a period of time tb 1, and the transmission path of the driving current I0 in the display phase H212 outside the period will be turned off; and if the writing phase H221 data signal D2 is at a high level as an inactive level, and transistor T4 and transistor T6 are turned off, so that no matter what waveform the periodic pulse signal EK is, the driving current I0 in the display phase H222 thereafter, the transmission path will be disconnected.

Thus, the total lighting duration in the entire driving phase H2 can be controlled by whether data signal D2 is an active level or an inactive level in each writing phase—as an example, since tb1, tb2, tb3 are different.

Therefore, data signal D2 can be made to be in an active level in one of the three writing phases, such that the driving periods of the different grayscale ranges correspond to one of tb1, tb2, and tb3, respectively (for example, the grayscale range 0~6 corresponds to tb1=1.11 μs; the grayscale range 7~44 corresponds to tb2=66.66 μs; and the grayscale range 45~255 corresponds to tb3=4000 μs), thereby implementing the above functions of the time control circuit 12.

In yet another example, data signal D2 may be an active level during two or more display phases within one drive phase, such that the total illumination duration in each drive phase may be equal to not only tb1, tb2, tb3, wherein one of them can also be the sum of two or more of them.

Figure 6:
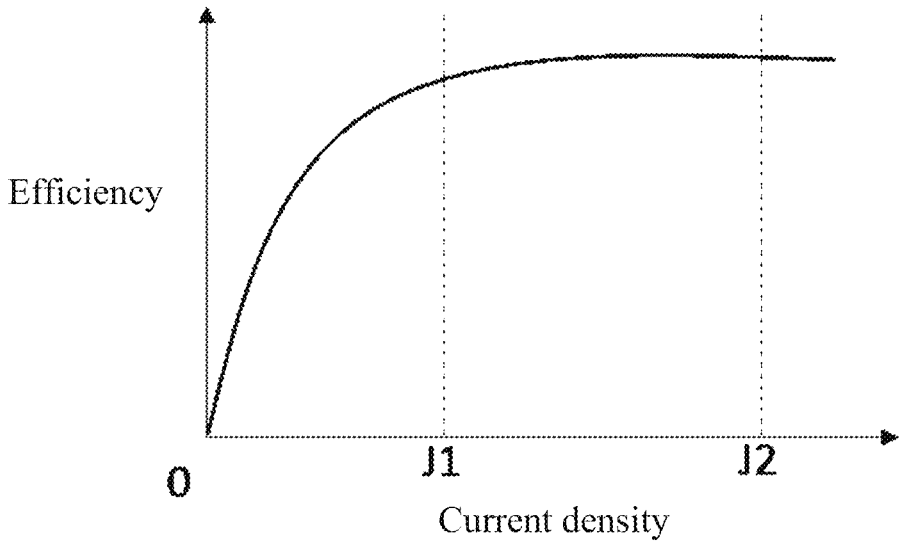
FIG. 6 is a schematic diagram of device characteristics of an element to be driven according to an embodiment of the present disclosure.

FIG. 6 is a schematic diagram of device characteristics of an element to be driven according to an embodiment of the present disclosure.

As shown in FIG. 6, the light-emission efficiency of the element target L0 gradually increases as the current density increases, and is stabilized at a maximum value when the current density is between J1 and J2.

Therefore, in order to save display power consumption, it is generally required that the device to be driven L0 operates in a state in which the current density is between J1 and J2.

However, the range of current density between J1 and J2 is extremely limited for many types of elements to be driven L0, and if different gray levels are obtained by adjusting the current magnitude, the resulting display contrast may be very low.

For example, at J1=0.2 A/cm$^2$, J2=12 A/cm$^2$, the contrast is 12/0.2=60, which is too low for most display applications.

In some embodiments of the present disclosure, the time control circuit 12 can adjust the conduction duration of the driving current I0 in each driving cycle, so that high contrast can be realized under the premise that the current density is in a stable range. Taking tb1=1.11 μs, tb2=66.66 μs, tb3=4000 μs as an example, when J1=0.2 A/cm$^2$ and J2=12 A/cm$^2$, the maximum contrast is (12×4000)/(0.2×1.11)≈210000, far greater than 60 and meets the contrast requirements of most display applications.

It can be seen that the technical solution of the embodiments of the present disclosure can achieve high contrast under the premise that the current density of the component to be driven is in a stable range, which can help to avoid the color density of the component to be driven being outside the stable range, causing color shift, efficiency degradation, and the like. The problem, in turn, can help achieve the high contrast required for display products.

Therefore, embodiments of the present disclosure can help alleviate display defects caused by light-emitting devices whose characteristics are easily drifted with current density, and improve display performance of related display products.

Figure 7:
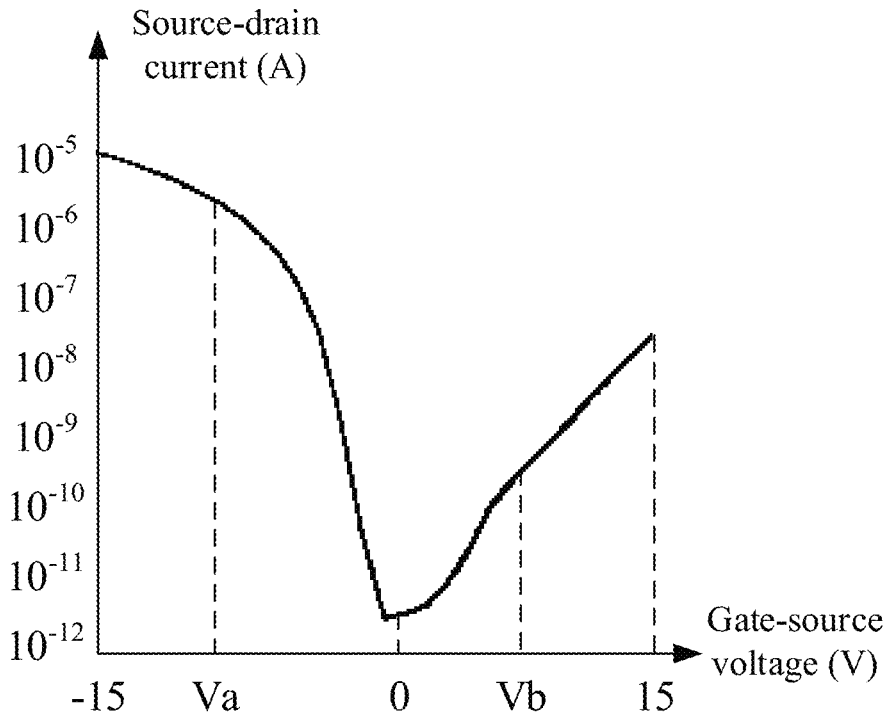
FIG. 7 is a transfer characteristic curve of a transistor in a driving circuit according to an embodiment of the present disclosure.

FIG. 7 shows a transfer characteristic curve of a transistor in a driving circuit according to an embodiment of the present disclosure.

Here, a p-channel thin film transistor is taken as an example to illustrate the operation of a transistor mainly serving as a time control function in the two circuits of FIG. 2 and FIG. 4.

Referring to FIG. 2 and FIG. 7, the transistor mainly serving as time control in FIG. 2 is transistor T1; for the purpose of time control, the voltage at node Q4 changes within a certain range during operation (for example, the source voltage of a transistor T1 is between −15V and +15V of the reference).

At this time, the gate-source voltage of transistor T1 in FIG. 7 can be any point between −15V and +15V, and the source and drain currents can also be any point on the curve, which is expressed as an adjustment of the magnitude of the current value of the drive current I0 within a certain range.

Referring to FIG. 4 and FIG. 7, the transistor mainly serving as the control in FIG. 7 is transistor T3; as can be seen from the above working principle, the voltage at the gate of transistor T3 is only high in the periodic pulse signal EK.

The level voltage and the low-level voltage are switched, so that the gate-source voltage thereof is switched only between the voltage Va and the voltage Vb (as an example, the voltage Va is about 10V and the voltage Vb is about 7V).

Therefore, the source-drain current of transistor T3 has only a state in which the value on the left side of the curve is large (corresponding to the on state of transistor T3) and a state in which the value on the right side is small (corresponding to the off state of transistor T3). It is expressed as a switching control of the transmission path of the driving current I0.

In current source circuit 11, referring to FIG. 4 and FIG. 5, in the initialization H11, the opening of transistor T8 causes capacitor C3 to be charged or discharged until the voltage at node Q4 is equal to the initial voltage line Vini.

In the compensation H12, transistor T9 and transistor T5 are turned on, and the first voltage terminal VDD is charged to node Q4 through the driving transistor TD until the voltage at node Q4 is equal to the voltage of data signal D1. The sum of Vdata1 and the threshold voltage Vth of the driving transistor TD (the voltage on the initialization voltage line Vini needs to be lower than this voltage value).

When the transmission path of the driving current I0 is turned on thereafter, the source-drain current (i.e., the driving current I0) of the driving transistor TD is equal to $K(Vdata1+Vth-Vd-Vth)^2$ under the clamping action of capacitor $C3=K(Vdata1-Vd)^2$, where K is the device parameter of the driving transistor TD, and Vd is the voltage value at the first voltage terminal VDD.

It can be seen that the magnitude of the driving current I0 at this time is independent of the threshold voltage Vth of the driving transistor TD, that is, the threshold voltage is compensated.

It should be understood that circuit structures of the current source circuit 11 shown in FIGS. 2 and 4 are each an exemplary implementation of the current source circuit 11, and the circuit structure of the current source circuit 11 in FIGS. 2 and 4 can be exchanged with each other.

In addition to the above configurations, other similar circuit configurations may be employed to implement the above-described functions of the current source circuit 11, without being limited to the manners involved in the embodiments of the present disclosure.

In addition, it should be understood that the above-mentioned light-emitting control circuit 13 may also be disposed in the driving circuit of FIG. 4, and if it is added between the first voltage terminal VDD and the current source circuit 11 in the driving circuit shown in FIG. 4.

When the light-emitting control circuit 13 is illuminated, the periodic pulse signal line EM needs to be inactive in the compensation H12 to prevent the first voltage terminal VDD from being charged to node Q4 through the driving transistor TD.

It should be noted that although the foregoing description is made by taking the current source circuit 11 as one of the first voltage terminal and the second voltage terminal, the current source circuit 11 may include a power source capable of generating the driving current I0.

The power supply or energy storage component, the drive circuit may not need to have the first voltage end, and the current source circuit 11 does not need to be connected to the first voltage terminal or the second voltage terminal.

Based on the same concept illustrated above, some embodiments of the present disclosure provide a driving method performed by a driving circuit, which corresponds to any one of the above driving circuits, and the method can include the following operations.

Providing, in each driving cycle, a first data signal to a current source circuit through the first data line, and a second data signal to a time control circuit through the second data line, so as to cause the current source circuit to control the magnitude of current provide to a target element based on the first data signal, and to cause the time control circuit to control the duration of the current supplied to the target element according to the second data signal.

The above stated time control circuit in the driving circuit may further include a first switching sub-circuit, a first holding sub-circuit, and a first writing sub-circuit.

In the above, during every driving cycle, a first data signal is provided to the current source circuit via a first signal data line; a second signal is provided to the time control circuit via a second data line; whereby, the first data signal controls the magnitude of current provided to the target element, and the second data signal controls the duration of the current provide to the target element, for example, through one or more of the following operations.

Providing the first data signal to the current source circuit through the first data line and the second data to the first writing sub-circuit through the second data line during a preparation phase of each driving cycle transmitting, by the first scan line, the first writing sub-circuit to conduct the second data line and the first node.

Providing, by the pulse signal end, the periodic pulse signal to the first holding sub-circuit during a driving phase of each driving period, the periodic pulse signal being the same in each of the driving stages a waveform such that the first holding sub-circuit controls the level at the first node to vary with the periodic pulse signal by maintaining a voltage difference between the first end and the second end such that the first switching sub-circuit is the length of time during which the current path is turned on in the driving phase is determined by the level of the second data signal provided in the preparation phase.

The drive phase in each of the drive cycles can be after the preparation phase within the drive cycle.

When the time control circuit in the driving circuit includes the second switching sub-circuit, the third switching sub-circuit, and the second writing sub-circuit, the current source circuit is provided to the current source circuit through the first data line in each driving cycle. Determining, by the first data signal, the second data signal to the time control circuit through the second data line, so that the current source circuit controls the magnitude of the driving current supplied to the target element according to the first data signal, And causing the time control circuit to control the duration of the driving current to the target element according to the second data signal, which can further include the following operations.

Providing a first data signal to the current source circuit through the first data line during a preparation phase of each drive cycle; the preparation phase within each of the drive cycles is prior to a drive phase within the drive cycle The drive phase includes at least two sub-phases, each of which includes a write phase and a display phase subsequent to the write phase.

Providing a second data signal to the second write sub-circuit through the second data line during the writing phase of each of the sub-phases, and controlling the second write sub-circuit by the first scan line The second data line is electrically connected to the second node, so that the second node is the second data signal.

Providing a periodic pulse signal to the third switching sub-circuit through the pulse signal end during the display phase of each of the sub-phases to provide the third switching sub-circuit in the preparation phase Controlling the conduction between the pulse signal end and the third node when the second data signal is at an active level, such that the duration of the second switch sub-circuit turning on the current path in the display phase is the length of time during which the periodic pulse signal is at the active level is determined during the display phase.

It should be understood that the foregoing implementations and related descriptions of the method of the present embodiment have been included in the circuit timing and the working principle of the driving circuit, and therefore are not described herein again. It can be seen that the embodiments of the present disclosure respectively control the grayscale of the pixel in each driving cycle in two dimensions of the current magnitude and the current duration by the current source circuit and the time control circuit, thereby enabling the current of the component to be driven.

The density does not exceed the range of its stable operation, and the display contrast can be maintained by the difference between the current durations. Therefore, the embodiments of the present disclosure can help alleviate display defects caused by the light-emitting device whose characteristics are easily drifted with current density; thereby improving the display performance of related display products.

Based on the same concept illustrated above, some embodiments of the present disclosure provide a display device including a driving circuit of any of the above (the number is determined by the number of sub-pixels included in the display device).

The display device in the embodiments of the present disclosure can be any product or component having a display function such as, a display panel, a mobile phone, a tablet computer, a television, a display, a notebook computer, a digital photo frame, a navigator, and the like.

Figure 8:
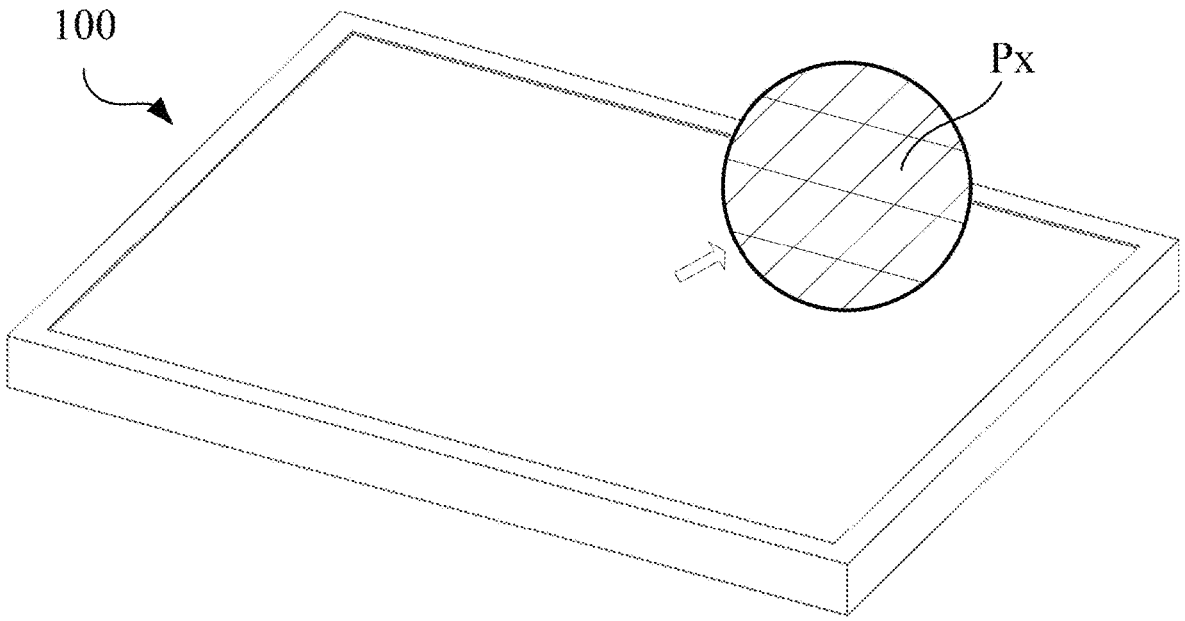
FIG. 8 is a schematic structural diagram of a display device according to an embodiment of the present disclosure.

For example, the display device 100 shown in FIG. 8 includes sub-pixel sub-circuits Px arranged in rows and columns in the display area, and each of the sub-pixel sub-circuits Px includes a driving circuit.

It can be seen that the embodiments of the present disclosure respectively control the grayscale of the pixel in each driving cycle in two dimensions of the current magnitude and the current duration by the current source circuit and the time control circuit, thereby enabling the current of the component to be driven.

The density does not exceed the range of its stable operation, and the display contrast can be maintained by the difference between the current durations.

Therefore, the embodiments of the present disclosure can help alleviate display defects caused by the light-emitting device whose characteristics are easily drifted with current density. Improve the display performance of related display products.

The driving circuit can be particularly advantageous for microLED display devices. Due to the manufacturing processes and material selections of the microLEDs, the efficiency and color coordinates of the microLEDs can change with the change of current densities.

Therefore, the large current densities will bring about the decrease of the efficiency and the drift of the color coordinates if the current densities cannot be changed on a large amplitude. The contrast will be low and the number of gray levels achieved will be small for the microLED display device.

Various embodiments of the present disclosure employ both the current and time to control the gray scales. For example, referring back to FIG. 2, time control can be controlled jointly by T2, C1, and T1.

When T2 is turned on, data Data2 (D2) can be read to first node Q1. Common (CM) is a signal that changes with time and can be shared by the entire display screen.

After T2 is disconnected, the voltage difference between the first node Q1 and the Common signal remains unchanged, so that the voltage at the first node Q1 will also change with time.

After changing to the turn-off voltage of T1, T1 is turned off and the LED is turned off. The turn-on time can be controlled by the input of different Data2 (D2) voltages, that is, the difference between Data2 (D2) and CM.

The current source can be provided for the Drive TFT TD, and Vth compensation can also be added.

The current source Data1 can have a variable voltage, or can be unchanged, and its range of variation can match the LED.

As such, the gray scale can be controlled according to the characteristics of the MicroLED by time and current, and the efficiency is higher, and the color shift is reduced.

Various embodiments of the present disclosure can have one or more of the following advantages.

Controlling the grayscale of the pixel can be realized in each driving cycle in two dimensions, i.e. the current magnitude and the current duration via the current source circuit and the time control circuit, respectively.

As such, the target element can be driven by the driving current in a controlled manner. In this way, the current density does not exceed the range of its stable operation, and the display contrast can be maintained by the difference between the current durations.

Therefore, various embodiments of the present disclosure can help alleviate display defects caused by the light-emitting device whose characteristics are easily drifted with the current density, and improve the related display performance.

It is apparent that those of ordinary skill in the art can make various modifications and variations to the embodiments of the disclosure without departing from the spirit and scope of the disclosure. Thus, it is intended that the present disclosure covers the modifications and the variations.

Various embodiments in this specification have been described in a progressive manner, where descriptions of some embodiments focus on the differences from other embodiments, and same or similar parts among the different embodiments are sometimes described together in only one embodiment.

It should also be noted that in the present disclosure, relational terms such as first and second, etc., are only used to distinguish one entity or operation from another entity or operation, and do not necessarily require or imply these entities having such an order or sequence. It does not necessarily require or imply that any such actual relationship or order exists between these entities or operations.

Moreover, the terms "include," "including," "comprise," "comprising," or any other variations thereof are intended to cover a non-exclusive inclusion within a process, method, article, or apparatus that comprises a list of elements including not only those elements but also those that are not explicitly listed, or other elements that are inherent to such processes, methods, goods, or equipment.

For example, in the case of no more limitation, the element defined by the sentence "includes a . . . " does not exclude the existence of another identical element in the process, the method, or the device including the element.

Specific examples are used herein to describe the principles and implementations of some embodiments. The description is only used to help convey understanding of the possible methods and concepts. Meanwhile, those of ordinary skill in the art may change the specific manners of implementation and application thereof without departing from the spirit of the disclosure. The contents of this specification therefore should not be construed as limiting the disclosure.

For example, in the description of the present disclosure, the terms "some embodiments," "various embodiments," "exemplary embodiment," or "example," and the like may indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described may be combined in a suitable manner in any one or more embodiments or examples. In addition, various embodiments or examples described in the specification, as well as features of various embodiments or examples, may be combined and reorganized.

In the descriptions, with respect to circuit(s), unit(s), device(s), component(s), etc., in some occurrences singular forms are used, and in some other occurrences plural forms are used in the descriptions of various embodiments. It should be noted; however, the single or plural forms are not limiting but rather are for illustrative purposes. Unless it is expressly stated that a single unit, device, or component etc. is employed, or it is expressly stated that a plurality of units, devices or components, etc. are employed, the circuit(s), unit(s), device(s), component(s), etc. can be singular, or plural.

Based on various embodiments of the present disclosure, the disclosed apparatuses, devices, and methods may be implemented in other manners. For example, the abovementioned devices can employ various methods of use or implementation as disclosed herein.

Dividing the device into different "regions," "portions," "modules," "units," or "layers," etc. merely reflect various logical functions according to some embodiments, and actual implementations can have other divisions of "regions," "portions," "modules," "units," or "layers," etc. realizing similar functions as described above, or without divisions. For example, multiple regions, units, or layers, etc. may be combined or can be integrated into another system. In addition, some features can be omitted, and some steps in the methods can be skipped.

Those of ordinary skill in the art will appreciate that the units, regions, or layers, etc. in the devices provided by various embodiments described above can be provided in the one or more devices described above. They can also be located in one or multiple devices that is (are) different from the example embodiments described above or illustrated in the accompanying drawings. For example, the units, regions, or layers, etc. in various embodiments described above can be integrated into one module or divided into several submodules.

The order of the various embodiments described above are only for the purpose of illustration, and do not necessarily represent preference of embodiments.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to the disclosed aspects of the exemplary embodiments can be made in addition to those described above by a person of ordinary skill in the art having the benefit of the present disclosure without departing from the spirit and scope of the disclosure contemplated by this disclosure and as defined in the following claims. As such, the scope of this disclosure is to be accorded the broadest reasonable interpretation so as to encompass such modifications and equivalent structures.

It should be understood that "a plurality" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

In the description of the present disclosure, the terms "some embodiments," "example," or "some examples," and the like may indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described may be combined in a suitable manner in any one or more embodiments or examples. In addition, various embodiments or examples described in the specification, as well as features of various embodiments or examples, may be combined and reorganized.

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombinations.

Moreover, although features can be described above as acting in certain combinations and even initially claimed as such, one or more features from a claimed combination can in some cases be excised from the combination, and the claimed combination can be directed to a subcombination or variations of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. A driving circuit for driving a target element with a driving current, comprising:

a current source circuit connect to the target element and a first data line; wherein the current source circuit is configured to:

receive a first data signal through the first data line; and control the magnitude of the driving current provided to the target element based on the first data signal;

a time control circuit connected to the current source circuit, a second data line, and a pulse signal terminal, wherein the time control circuit is configured to:

receive a second data signal through the second data line;

receive a periodic pulse signal via the pulse signal terminal; and control the duration of the driving current provided to the target element in every driving period based on the second data signal and the periodic pulse signal.

2. The driving circuit according to claim 1, wherein the time control circuit comprises:

a first switching sub-circuit connected to the current source circuit and a first node, wherein the first switching sub-circuit is configured to control the on and off state of the driving current based on an electrical level at the first node;

a first holding sub-circuit, having:

a first terminal connected to the pulse signal terminal, and a second terminal connected to the first node, wherein the first holding sub-circuit is configured to maintain a voltage difference between the first terminal and the second terminal;

a first writing sub-circuit connected to the second data line, the first node and a first scan line, wherein the first writing sub-circuit is configured to control the on and off state of the connection between the second data line and the first node based on an electrical level of the first scan line.

3. The driving circuit according to claim 2, wherein:

the first switching sub-circuit comprises a first transistor;

the first holding sub-circuit comprises a first capacitor; and the first writing sub-circuit comprises a second transistor; and wherein:

the first transistor has:

a gate connected to the first node, a first terminal connected to the current source circuit, and a second terminal connected to the target element through a light-emitting control circuit;

the first capacitor has:

a first terminal connected to the first terminal of the first holding sub-circuit, and a second terminal connected to the second terminal of the first holding sub-circuit; and the second transistor has:

a gate connected to the first scan line, a first terminal connected to the second data line, and a second terminal connected to the first node.

4. The driving circuit according to claim 1, wherein:

the driving circuit further comprises the target element to be driven; and the current source circuit, the time control circuit, and the target element are connected in series between a first voltage terminal and a second voltage terminal of the driving circuit to provide a current path for the driving current.

5. The driving circuit according to claim 4, wherein the current source circuit comprises:

a driving transistor having a gate connected to a fourth node, a first terminal connected to the first voltage terminal, and a second terminal connected to the target element through the time control circuit;

a third capacitor have a first terminal connected to the fourth node, and a second terminal connected to the first voltage terminal; and a seventh transistor having a gate connected to the second scan line, a first terminal connected to the first data line, and a second terminal connected to the fourth node.

6. The driving circuit according to claim 1, wherein the time control circuit comprises:

a second switching sub-circuit connected to the current source circuit, a second node and a third node, wherein the second switching sub-circuit is configured to control the on and off state of the driving current based on electrical levels of the second node and the third node;

a second writing sub-circuit connected to the second data line, the first scan line and the second node, wherein the second writing sub-circuit is configured to control the on and off state of the connection between the second data line and the second node based on an electrical level of the first scan line; and a third switching sub-circuit connected to the second node, the third node and the pulse signal terminal, wherein the third switching sub-circuit is configured to control the on and off state of the connection between the periodic pulse signal terminal and the third node Q3 based on an electrical level of the second node.

7. The driving circuit according to claim 6, wherein:

the second switching sub-circuit comprises a third transistor and a fourth transistor;

the second writing sub-circuit comprises a fifth transistor;

the third switching sub-circuit comprises a sixth transistor; and the time control circuit comprising a second capacitor: and wherein:

the third transistor has:

a gate connected to the third node a first terminal connected to the current source circuit; and a second terminal connected to a first terminal of the fourth transistor;

the fourth transistor has:

a gate connected to the second node;

the first terminal connected to the second terminal of the third transistor; and a second terminal connected to a terminal of the target element that receives the driving current;

the fifth transistor has:

a gate connected to the first scan line;

a first terminal connected to the second data line; and a second terminal connected to the second node;

the sixth transistor has:

a gate connected to the second node;

a first terminal connected to the third node; and a second terminal connected to the pulse signal terminal; and the second capacitor has:

a first terminal connected to the second node; and a second terminal connected to a common terminal of the driving circuit.

8. The driving circuit according to claim 4, wherein the current source circuit comprises:

a driving transistor having a gate connected to a fourth node, a first terminal connected to the first voltage terminal, and a second terminal connected to the target element through the time control circuit;

a third capacitor having a first terminal connected to the fourth node, and a second terminal connected to the first voltage terminal;

a seventh transistor having a gate connected to the second scan line, a first terminal connected to the first data line, and a second terminal connected to the target element through the time control circuit;

an eighth transistor having a gate connected to a third scan line, a first terminal connected to an initialization voltage line, and a second terminal connected to the fourth node; and a ninth transistor having a gate connected to the second scan line, a first terminal connected to the fourth node, and a second terminal connected to the target element through the time control circuit.

9. The driving circuit according to claim 8, wherein:

the target element is a light-emitting element; and the light-emitting element is configured to emit light according to the driving current.

10. The driving circuit according to claim 9, wherein:

the driving circuit further comprises a light-emitting control circuit connected to the current source circuit and a periodic pulse signal line; and the light-emitting control circuit is configured to control the on and off sate of the driving current based on an electrical level of the periodic pulse signal line.

11. The driving circuit according to claim 10, wherein the light-emitting control circuit comprises a tenth transistor having:

a gate connected to the periodic pulse signal line;

a first terminal connected to the current source circuit; and a second terminal connected to the target element or the first voltage terminal.

12. A display device, comprising:

a plurality of driving circuits each according to claim 1; and a display screen including a plurality of micro light-emitting diodes (microLEDs) driven by the plurality of driving circuits.

13. The display device according to claim 12, wherein the plurality of driving circuits are configured to control gray scales of the plurality of microLEDs with both current and time.

14. The display device according to claim 13, wherein:

the plurality of driving circuits are configured to control the gray scales with the time jointly through parameters of the second transistors, the first capacitors, and the first transistors.

15. The display device according to claim 14, wherein:

the display device comprises a display screen having a plurality of pixels formed with the plurality of microLEDs;

the plurality of driving circuits are configured to control the gray scales with the time by turning on the second transistors, thereby reading data to the first nodes; and a common signal changes with time and is shared by the entire display screen.

16. The display device according to claim 15, wherein:

the plurality of driving circuits are configured to control the gray scales with the time by having voltage at the first node changing with the time; and a voltage difference between the first node and the common signal remains unchanged after the second transistors are disconnected.

17. The display device according to claim 16, wherein:

the plurality of driving circuits are configured to the plurality of MicroLEDs by applying a turn-off voltage to the first transistors; and a turn-on time is controlled by a difference between a second data signal and the common signal, thereby controlling the gray scales according to characteristics of the plurality of MicroLEDs and improving efficiency and reducing color shift.

18. A method of driving a target element performed by a driving circuit according to claim 1, the method comprising:

providing, in each driving cycle, the first data signal to the current source circuit through the first data line;

providing the second data signal to the time control circuit through the second data line;

providing the periodic pulse signal to the time control circuit via the periodic pulse signal terminal;

controlling, with the current source circuit, magnitude of the driving current; and controlling, with the time control circuit, duration of the driving current based on the second data signal.

19. The method of claim 18, wherein the time control circuit comprises:

a first switching sub-circuit connected to the current source circuit and a first node Q1, wherein the first switching sub-circuit is configured to control the on and off state of the driving current based on an electrical level at the first node Q1;

a first holding sub-circuit, having:

a first terminal connected to the pulse signal terminal, and a second terminal connected to the first node Q1, wherein the first holding sub-circuit is configured to maintain a voltage difference between the first terminal and the second terminal;

a first writing sub-circuit connected to the second data line, the first node Q1 and a first scan line, wherein the first writing sub-circuit is configured to control the on and off state of the connection between the second data line and the first node Q1 based on an electrical level of the first scan line; and wherein the method further comprises:

controlling the first writing sub-circuit via the first scan line so as to cause the second data line to connect with the first node during the preparation phase of each driving period by providing the first data signal to the current source circuit via the first data line, and providing the second data signal to the first writing sub-circuit via the second data line; and controlling the electrical level of the first node to vary according to the periodic pulse signal during the driving phase of each driving cycle by providing the periodic pulse signal to the first holding sub-circuit via the periodic pulse signal terminal so as to cause the first holding sub-circuit to maintain a voltage difference between the first voltage terminal and the second voltage terminal, wherein the driving phase of each driving cycle occurs after the preparation phase of each cycle.

20. The method of claim 18, wherein the time control circuit comprises:

a second switching sub-circuit connected to the current source circuit, a second node Q2 and a third node Q3, wherein the second switching sub-circuit is configured to control the on and off state of the driving current based on electrical levels of the second node Q2 and the third node Q3;

a second writing sub-circuit connected to the second data line, the first scan line and the second node Q2, wherein the second writing sub-circuit is configured to control the on and off state of the connection between the second data line and the second node Q2 based on an electrical level of the first scan line;

a third switching sub-circuit connected to the second node Q2, the third node Q3 and the pulse signal terminal, wherein the third switching sub-circuit is configured to control the on and off state of the connection between the periodic pulse signal terminal and the third node Q3 based on an electrical level of the second node Q2;

wherein:

during the preparation phase of each driving cycle, the first data signal is provided to the current source circuit via the first data line;

the preparation phase occurs before the driving phase;

the driving phase includes at least two sub-phases, each sub-phased includes a writing phase and a subsequent display phase;

during the writing phase of each sub-phase, the second data signal is provided to the second writing sub-circuit via the second data line, the second writing sub-circuit is controlled by the first scan line so as to cause the second data line and the second node to be in an on or off state so as to make the second node to become the second data signal; and during the display phase of each sub-phase, providing the periodic pulse signal to the third switching sub-circuit via the periodic pulse terminal so as to cause the third switching sub-circuit to control the periodic pulse terminal to connect with the third node if the second data signal provide during the preparation phase is a valid electrical level, and based on the electrical levels at the second node and the third node, causing the second switching sub-circuit to turn on or off the current path.

* * * * *